US008704449B2

(12) United States Patent
Yang et al.

(10) Patent No.: US 8,704,449 B2
(45) Date of Patent: Apr. 22, 2014

(54) LED BACKLIGHT DRIVING CIRCUIT, LIQUID CRYSTAL DISPLAY DEVICE AND DRIVING CIRCUIT

(75) Inventors: Xiang Yang, Shenzhen (CN); Xinming Gao, Shenzhen (CN); Fei Li, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 2 days.

(21) Appl. No.: 13/519,151

(22) PCT Filed: May 16, 2012

(86) PCT No.: PCT/CN2012/075599

§ 371 (c)(1),
(2), (4) Date: Jun. 26, 2012

(87) PCT Pub. No.: WO2013/166739

PCT Pub. Date: Nov. 14, 2013

(65) Prior Publication Data

US 2013/0300983 A1 Nov. 14, 2013

(30) Foreign Application Priority Data

May 9, 2012 (CN) ..... 2012 1 0142204

(51) Int. Cl.
*H05B 37/02* (2006.01)

(52) U.S. Cl.
USPC ..... 315/192; 315/122

(58) Field of Classification Search
None
See application file for complete search history.

(56) References Cited

U.S. PATENT DOCUMENTS

| | | | | |
|---|---|---|---|---|
| 5,414,325 | A | 5/1995 | Allison | |
| 2010/0301762 | A1 * | 12/2010 | Kung et al. | 315/193 |
| 2011/0025234 | A1 | 2/2011 | Ohtaka et al. | |
| 2011/0227493 | A1 * | 9/2011 | Du et al. | 315/192 |
| 2013/0099684 | A1 * | 4/2013 | Cheng et al. | 315/186 |

FOREIGN PATENT DOCUMENTS

| | | | |
|---|---|---|---|
| CN | 1918718 | A | 2/2007 |
| CN | 1956045 | A | 5/2007 |
| CN | 101588664 | A | 11/2009 |
| CN | 102402953 | A | 4/2012 |
| JP | 2007189103 | A | 7/2007 |

OTHER PUBLICATIONS

Han Xu, the International Searching Authority written comments, Feb. 2013, CN.

* cited by examiner

*Primary Examiner* — Crystal L Hammond
(74) *Attorney, Agent, or Firm* — IPro, Inc.; Na Xu

(57) ABSTRACT

The invention discloses an LED backlight driving circuit, an LCD device and a driving circuit. The LED backlight driving circuit includes a power supply module, an LED lightbar coupled with an output terminal of the power supply module, a dimming module coupled with the output terminal of the LED lightbar, and the LED backlight driving circuit further includes a transfer switch. A first input terminal of the transfer switch is coupled to the output terminal of the LED lightbar, and a second input terminal of the transfer switch is coupled to a feedback voltage. The output terminal of the transfer switch is coupled to the power supply module. The transfer switch is switched to the first input terminal when the dimming module is ON, and the transfer switch is switched to the second input terminal when the dimming module is OFF. Therefore, the LEDs of the invention can operate normally within the short dimming cycle. The invention only adds one transfer switch, the circuit is simple and does not increase the circuit area, and the cost is low.

14 Claims, 2 Drawing Sheets

LED BACKLIGHT DRIVING CIRCUIT, LIQUID CRYSTAL DISPLAY DEVICE AND DRIVING CIRCUIT

TECHNICAL FIELD

The invention relates to the field of liquid crystal displays (LCDs), and more particularly to a light emitting diode (LED) backlight driving circuit, an LCD device, and a driving circuit.

BACKGROUND

LEDs are used as backlight sources by more and more LCD devices, with the maturing of LED technology and the cost reduction of the LEDs. An LED driver is different from a conventional power supply driver, and generally adopts the pulse-width modulation (PWM) technology to regulate the brightness. As shown in FIG. 1, the LED driver is in a dimming state, when the PWM of a dimming signal is ON, a switch tube of a power supply end is conducted and the energy is transported to a back-end capacitor CP2 and an LED lightbar; when the PWM of the dimming signal is OFF, the driving circuit is out of operation, and at the moment, the LEDs also go out.

When the PWM is OFF for a too long time, the charges of the capacitor will still be consumed by the leakage current of the LEDs, and at the moment, more energy is required for charging the LEDs and the capacitor when the PWM is ON. Thus, when the PWM is ON for a too short time, the required energy cannot be achieved, namely, the LEDs will not operate within a shorter dimming cycle.

SUMMARY

The aim of the invention is to provide an LED backlight driving circuit, an LCD device and a driving circuit, which can operate normally within a short dimming cycle.

The aim of the invention is achieved by the following technical schemes.

An LED backlight driving circuit comprises a power supply module, an LED lightbar coupled with an output terminal of the power supply module, a dimming module coupled with the output terminal of the LED lightbar; the LED backlight driving circuit further comprises a transfer switch. A first input terminal of the transfer switch is coupled to the output terminal of the LED lightbar, and a second input terminal of the transfer switch is coupled to a feedback voltage; the output terminal of the transfer switch is coupled to the power supply module; the transfer switch is switched to the first input terminal when the dimming module is ON, and the transfer switch is switched to the second input terminal when the dimming module is OFF.

Preferably, the transfer switch is coupled with a control signal of the dimming module. When the control signal drives the dimming module to be conducted, the transfer switch is switched to the first input terminal; when the control signal drives the dimming module to be blocked, the transfer switch is switched to the second input terminal; thereby, the transfer switch is controlled by the control signal of the dimming module, without providing an additional control signal. This is a simpler control mode.

Preferably, the transfer switch comprises a first switch tube and a second switch tube. The input terminal of the first switch tube is coupled to the output terminal of the LED lightbar, and the control end of the first switch tube is coupled with the control signal of the dimming module; the input terminal of the second switch tube is coupled to the feedback voltage, and the control end of the second switch tube is coupled with the control signal of the dimming module via a NOT gate; the output terminals of the first switch tube and the second switch tube are electrically connected and coupled to a feedback module of the power supply module. Because the PWM signal has very high frequency, both the two switch tubes are used as the transfer switch and can operate reliably in the transferring action at high frequency.

Preferably, the feedback voltage is lower than the voltage of the output terminal of the LED lightbar. When the PWM is OFF, only a very low holding current is required to be provided to compensate the leakage current from the capacitor. Thus, only the very low feedback voltage is required.

Preferably, the LED backlight driving circuit comprises a comparator, the output terminal of the transfer switch is coupled to the comparison end of the comparator, the reference end of the comparator is coupled with a triangular wave signal, and the output terminal of the comparator is coupled to the control end of the power supply module. The triangular wave signal and the signal of the comparison end are mixed to form a square wave control signal, facilitating adjusting the duty ratio.

Preferably, the power supply module comprises an inductor and a control switch tube which are connected in series; the LED lightbar is coupled between the inductor and the control switch tube via a diode, and the output terminal of the comparator is coupled to the control end of the control switch tube. This is a specific structure of the power supply module, and a boost circuit is used for improving the drive capability of the LED lightbar.

Preferably, the dimming module comprises a dimming switch tube, and the dimming switch tube is in series connection with the LED lightbar. The power supply end regulates the brightness of the LEDs by a mode of regulating voltage, but the regulation range is limited. The dimming switch tube is in series connection in the branch circuit of the LED lightbar, thus, the effective current of the branch circuit of the LED lightbar can be regulated by controlling the duty ratio of the dimming switch tube, and the brightness can be regulated by a mode of controlling the current, thereby, extending the dimming range and improving the flexibility of dimming mode.

An LCD device comprises the LED backlight driving circuit mentioned above.

An LED backlight driving method comprises: switching a transfer switch to a first input terminal when a dimming module is ON; feeding the voltage of an output terminal of an LED lightbar back to a power supply module; switching the transfer switch to a second input terminal when the dimming module is OFF; and feeding a feedback voltage back to the power supply module.

Preferably, the transfer switch comprises a first switch tube and a second switch tube. The input terminal of the first switch tube is coupled to the output terminal of the LED lightbar, the control end of the first switch tube is coupled to a control signal of the dimming module; the input terminal of the second switch tube is coupled to the feedback voltage, and the control end of the second switch tube is coupled to the control signal of the dimming module via a NOT gate. Because the PWM signal has very high frequency, both the two switch tubes are used as the transfer switch and can operate reliably in the transferring action at high frequency.

In the invention, because the transfer switch is adopted for controlling the output of the power supply module, when the dimming module is ON, the transfer switch is switched to the output terminal of the LED lightbar and the power supply module keeps the normal output; when the dimming module is OFF, the transfer switch is switched to a reference feedback voltage, the power supply module is kept being conducted by the feedback voltage; thus, even if the PWM is OFF for a long time, the power supply module still has the output to keep the capacitor in a charging state. When the PWM is ON, the electric quantity of the capacitor is overlapped with the electric quantity outputted by the power supply module to uniformly supply power for the LED lightbar and ensure that the LED lightbar emits light normally with adequate energy. Therefore, the LEDs of the invention can operate normally within the short dimming cycle. The invention only adds one transfer switch, thus, the circuit is simple and does not obviously increase the circuit area, and the cost is low

DETAILED DESCRIPTION

The invention will further be described in detail in accordance with the figures and the preferable examples.

The invention discloses an LED backlight driving circuit and an LCD device based on the LED backlight driving circuit.

Figure 1:
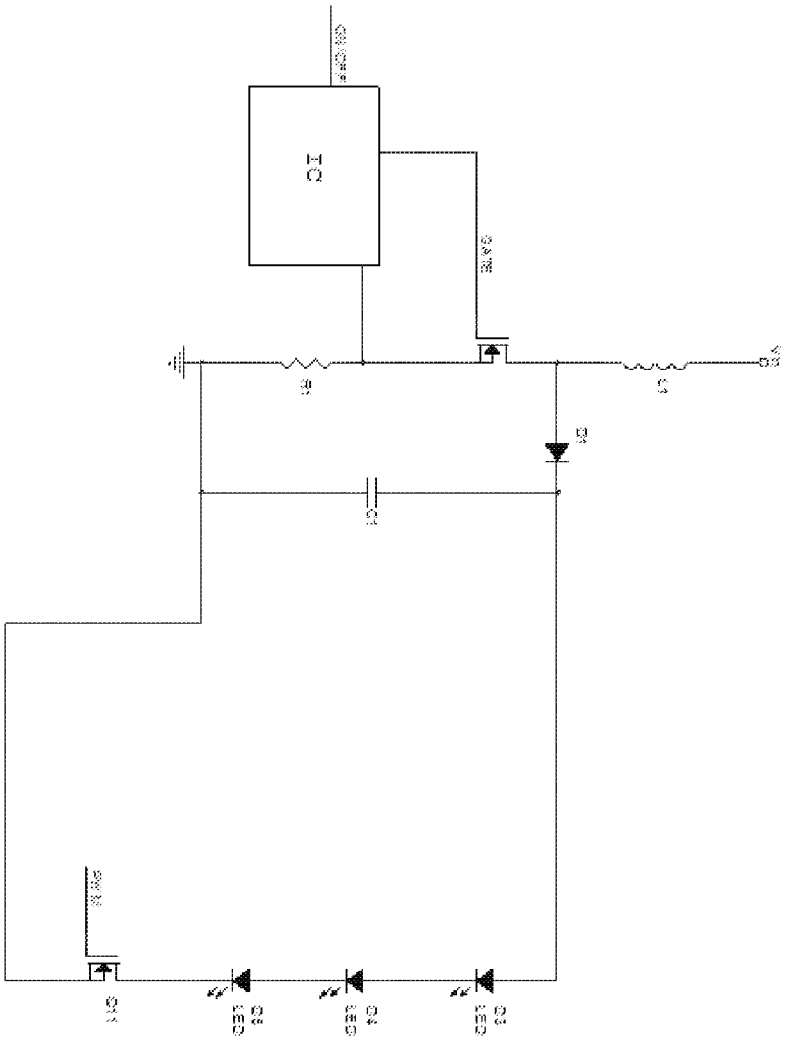
FIG. 1 is a schematic diagram of a conventional LED backlight driving circuit.
Figure 2:
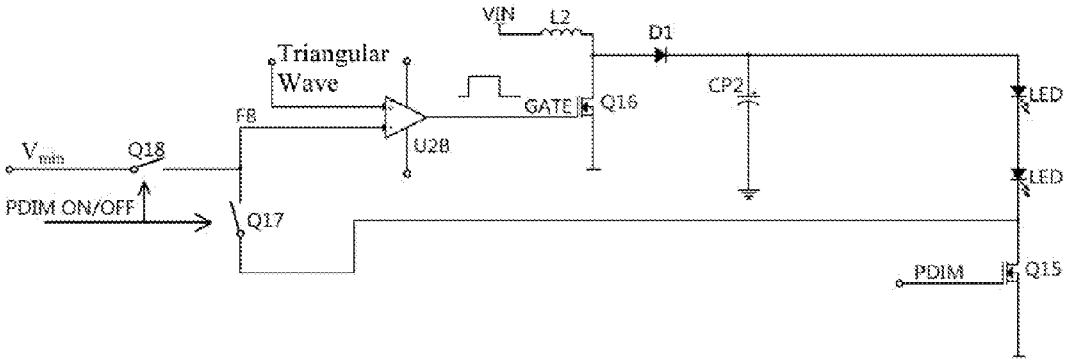
FIG. 2 is a principle schematic diagram of an example of the invention.
Figure 3:
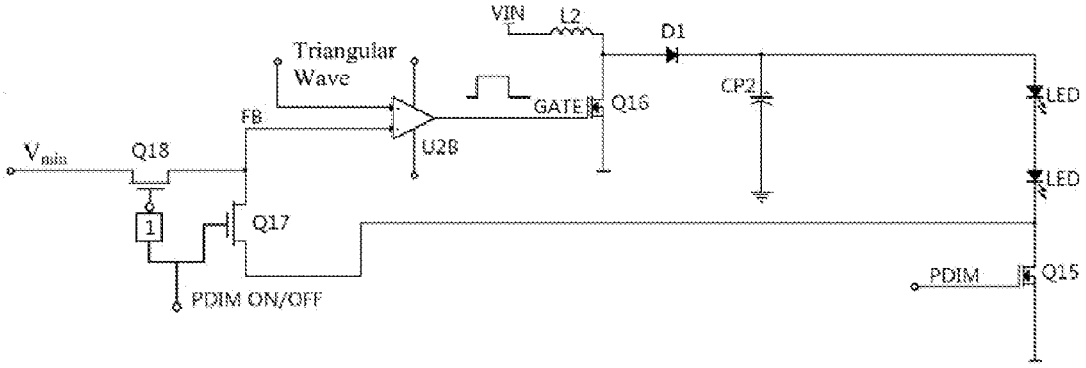
FIG. 3 is a principle schematic diagram of switch tubes as a transfer switch of an example of the invention.

As shown in FIG. 2, the LED backlight driving circuit comprises a power supply module, an LED lightbar coupled with the output terminal of the power supply module, a dimming module coupled with an output terminal of the LED lightbar, a comparator, and a transfer switch. A first input terminal SW1 of the transfer switch is coupled to the output terminal of the LED lightbar, a second input terminal SW2 is coupled to a feedback voltage $V_{min}$, and the output terminal of the transfer switch is coupled to the power supply module via a comparator; the transfer switch is switched to the first input terminal when the dimming module is ON, and the transfer switch is switched to the second input terminal when the dimming module is OFF.

A boost circuit is used in the power supply module, comprising an inductor L2 and a control switch tube Q16 which are in series connection. The LED lightbar is coupled between the inductor L2 and the control switch tube Q16 via a diode D1, the output terminal of the transfer switch is connected to a comparison end of the comparator, a reference end of the comparator is coupled with a triangular wave signal, and the output terminal of the comparator is coupled to a control end of the control switch tube Q16. The triangular wave signal and the signal of the comparison end are mixed to form a square wave control signal, facilitating adjusting the duty ratio.

The transfer switch is coupled with the control signal PDIM of the dimming module. When the control signal drives the dimming module to be conducted, the transfer switch is switched to the first input terminal SW1; when the control signal drives the dimming module to be blocked, the transfer switch is switched to the second input terminal SW2; thereby, the transfer switch is controlled by the control signal of the dimming module, without providing the additional control signal. This is a simpler control mode.

Furthermore, as shown in FIG. 2, the transfer switch comprises a first switch tube Q17 and a second switch tube Q18. The input terminal of the first switch tube Q17 is coupled to the output terminal of the LED lightbar, and the control end of the first switch tube Q17 is coupled with the control signal PDIM of the dimming module; the input terminal of the second switch tube Q18 is coupled to a feedback voltage $V_{min}$, and the control end of the second switch tube Q18 is coupled with the control signal PDIM of the dimming module via a NOT gate; the output terminals of the first switch tube Q17 and the second switch tube Q18 are electrically connected and coupled to the control switch tube Q16.

Because the PWM signal has very high frequency, therefore, the two switch tubes are used as the transfer switch and can operate reliably in the transferring action at high frequency.

The feedback voltage $V_{min}$ is lower than the voltage of the output terminal of the LED lightbar. When the PWM is OFF, only a very low holding current is required to be provided to compensate the leakage current from the capacitor. Thus, only the low feedback voltage is required.

The dimming module comprises a dimming switch tube Q15 which is arranged in series connection with the LED lightbar. The power supply end regulates the brightness of the LEDs by a mode of regulating voltage, but the regulation range is limited. The dimming switch tube is in series connection in the branch circuit of the LED lightbar, thus, the effective current of the branch circuit of the LED lightbar can be regulated by controlling the duty ratio of the dimming switch tube Q15, and the brightness can be regulated by a mode of controlling the current, thereby, extending the dimming range and improving the flexibility of dimming mode.

The invention also discloses a driving method of the LED backlight driving circuit, comprising:

A: Coupling the input terminal of the first switch tube Q17 to the output terminal of the LED lightbar, and coupling the control end of the first switch tube Q17 to the control signal of the dimming module; coupling the input terminal of the second switch tube Q18 to the feedback voltage $V_{min}$, and coupling the control end of the second switch tube Q18 to the control signal PDIM of the dimming module via the NOT gate;

B: Switching on the power supply, and switching the transfer switch to the first switch tube Q17 when the dimming module is ON; feeding the voltage of the output terminal of the LED lightbar back to the power supply module; switching the transfer switch to the second switch tube Q18 when the dimming module is OFF; feeding the feedback voltage back to the power supply module.

In the invention, because the transfer switch is adopted for controlling the output of the power supply module, when the dimming module is ON, the transfer switch is switched to the output terminal of the LED lightbar, and the power supply module keeps the normal output; when the dimming module is OFF, the transfer switch is switched to a reference feedback voltage, the power supply module is kept being conducted by the feedback voltage; thus, even if the PWM is OFF for a long time, the power supply module still has the output to keep the capacitor in a charging state; when the PWM is ON, the electric quantity of the capacitor is overlapped with the electric quantity outputted by the power supply module, to uniformly supply power for the LED lightbar and ensure that the LED lightbar emits light normally with adequate energy. Therefore, the LEDs of the invention can operate normally within the short dimming cycle. The invention only adds one transfer switch, the circuit is simple and does not obviously increase the circuit area, and the cost is low.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

We claim:

1. An LED backlight driving circuit, comprising: a power supply module, an LED lightbar coupled with an output terminal of the power supply module, a dimming module coupled with an output terminal of the LED lightbar, wherein said dimming module comprises a dimming switch tube; and said dimming switch tube is in series connection with said LED lightbar; wherein said LED backlight driving circuit further comprises a transfer switch; a first input terminal of said transfer switch is coupled to the output terminal of said LED lightbar, and a second input terminal of the transfer switch is coupled to an independent reference feedback voltage; the output terminal of the transfer switch is coupled to the power supply module; said transfer switch is switched to said first input terminal when the dimming module is ON, the transfer switch is switched to said second input terminal when the dimming module is OFF, and the power supply module is kept being conducted by the feedback voltage.

2. The LED backlight driving circuit of claim 1, wherein said transfer switch is coupled with a control signal of said dimming module; when the control signal drives the dimming module to be conducted, the transfer switch is switched to said first input terminal; when the control signal drives the dimming module to be blocked, the transfer switch is switched to said second input terminal.

3. The LED backlight driving circuit of claim 2, wherein said transfer switch comprises a first switch tube and a second switch tube; the input terminal of said first switch tube is coupled to the output terminal of said LED lightbar, and the control end of said first switch tube is coupled with the control signal of said dimming module;

the input terminal of said second switch tube is coupled to said feedback voltage, and the control end of said second switch is coupled with the control signal of said dimming module via a NOT gate; the output terminals of said first switch tube and said second switch tube are electrically connected and coupled to a feedback module of said power supply module.

4. The LED backlight driving circuit of claim 1, wherein said feedback voltage is lower than the voltage of the output terminal of said LED lightbar.

5. The LED backlight driving circuit of Claim I, wherein said LED backlight driving circuit comprises a comparator; the output terminal of said transfer switch is coupled to a comparison end of said comparator; a reference end of said comparator is coupled with a triangular wave signal; and the output terminal of said comparator is coupled to the control end of said power supply module.

6. The LED backlight driving circuit of claim 5, wherein said power supply module comprises an inductor and a control switch tube, and said inductor and said control switch tube are in series connection; said LED lightbar is coupled between said inductor and said control switch tube via a diode; the output terminal of said comparator is coupled to the control end of said control switch tube.

7. An LCD device, comprising an LED backlight driving circuit; said LED backlight driving circuit comprises a power supply module, an LED lightbar coupled with an output terminal of the power supply module, a dimming module coupled with an output terminal of the LED lightbar, wherein said dimming module comprises a dimming switch tube; and said dimming switch tube is arranged in series connection with said LED lightbar; wherein said LED backlight driving circuit further comprises a transfer switch; a first input terminal of said transfer switch is coupled to the output terminal of said LED lightbar, and a second input terminal of said transfer switch is coupled to an independent reference feedback voltage; the output terminal of said transfer switch is coupled to said power supply module; said transfer switch is switched to said first input terminal when said dimming module is ON, said transfer switch is switched to said second input terminal when said dimming module is OFF, and the power supply module is kept being conducted by the feedback voltage.

8. The LCD device of claim 7, wherein said transfer switch is coupled with a control signal of said dimming module; when the control signal drives the dimming module to be conducted, the transfer switch is switched to said first input terminal; and when the control signal drives the dimming module to be blocked, the transfer switch is switched to said second input terminal

9. The LCD device of claim 8, wherein said transfer switch comprises a first switch tube and a second switch tube; the input terminal of said first switch tube is coupled to the output terminal of said LED lightbar, and the control end of said first switch tube is coupled with the control signal of said dimming module; the input terminal of said second switch tube is coupled to said feedback voltage, and the control end of said second switch is coupled with the control signal of said dimming module via a NOT gate; the output terminals of said first switch tube and said second switch tube are electrically connected and coupled to a feedback module of said power supply module.

10. The LCD device of claim 7, wherein said feedback voltage is lower than the voltage of the output terminal of said LED lightbar.

11. The LCD device of claim 7, wherein the LED backlight driving circuit comprises a comparator, the output terminal of said transfer switch is coupled to a comparison end of said comparator, a reference end of said comparator is coupled with a triangular wave signal, and the output terminal of said comparator is coupled to the control end of said power supply module.

12. The LCD device of claim 11, wherein said power supply module comprises an inductor and a control switch tube and said inductor and said control switch tube are in series connection; said LED lightbar is coupled between said inductor and said control switch tube via a diode; and the output terminal of said comparator is coupled to the control end of said control switch tube.

13. An LED backlight driving method, comprising:

switching a transfer switch to a first input terminal when a dimming module is ON;

feeding the voltage of an output terminal of an LED lightbar back to a power supply module; switching the transfer switch to a second input terminal when the dimming module is OFF; and feeding a feedback voltage back to a power supply module, the power supply module is kept being conducted by the feedback voltage.

14. The LED backlight driving method of claim 13, wherein said transfer switch comprises a first switch tube and a second switch tube; an input terminal of said first switch tube is coupled to the output terminal of said LED lightbar, a control end of said first switch tube is coupled to a control signal of said dimming module; and the input terminal of said second switch tube is coupled to said feedback voltage, the control end of said second switch tube is coupled to the control signal of said dimming module via a NOT gate.

* * * * *